US007195069B2

(12) United States Patent
Roberts

(10) Patent No.: US 7,195,069 B2
(45) Date of Patent: Mar. 27, 2007

(54) METHOD AND APPARATUS FOR BACKING OFF A TUBULAR MEMBER FROM A WELLBORE

(75) Inventor: John Roberts, Magnolia, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/607,510

(22) Filed: Jun. 26, 2003

(65) Prior Publication Data

US 2004/0262004 A1 Dec. 30, 2004

(51) Int. Cl.
*E21B 31/00* (2006.01)
*E21B 41/00* (2006.01)
*E21B 28/00* (2006.01)

(52) U.S. Cl. ..... 166/301; 166/177.1; 166/297; 166/55; 175/56

(58) Field of Classification Search ..... 166/297, 166/301, 55, 177.1, 377; 175/56
See application file for complete search history.

(56) References Cited

U.S. PATENT DOCUMENTS 2,305,261 A * 12/1942 Kinley ..... 166/299
2,407,991 A * 9/1946 McCullough ..... 166/63
2,649,163 A 8/1953 Atkins, Jr.
2,948,059 A * 8/1960 Bodine, Jr. ..... 29/426.5
3,174,545 A 3/1965 Mohaupt
3,268,003 A 8/1966 Essary
3,994,163 A 11/1976 Rogers ..... 73/151
4,007,790 A 2/1977 Henning ..... 166/299
4,184,546 A 1/1980 Nicolas et al. ..... 166/206
4,299,279 A * 11/1981 Bodine ..... 166/72
4,396,065 A * 8/1983 McKenney ..... 166/301
4,402,219 A 9/1983 Hache ..... 73/151
4,407,365 A * 10/1983 Cooke, Jr. ..... 166/249
4,537,255 A 8/1985 Regalbuto et al. ..... 166/297
4,667,742 A 5/1987 Bodine
4,673,037 A * 6/1987 Bodine ..... 166/249
4,752,917 A * 6/1988 Dechape ..... 367/125
4,913,234 A * 4/1990 Bodine ..... 166/301
4,917,785 A 4/1990 Juvan ..... 204/164
4,941,202 A * 7/1990 Upton ..... 367/165
4,945,984 A 8/1990 Price ..... 166/63
5,037,524 A * 8/1991 Juvan ..... 204/660
5,043,952 A * 8/1991 Hoyle et al. ..... 367/159
5,184,678 A * 2/1993 Pechkov et al. ..... 166/249
5,220,504 A * 6/1993 Holzhausen et al. ..... 702/12
5,234,056 A * 8/1993 Bodine et al. ..... 166/301
5,351,754 A * 10/1994 Hardin et al. ..... 166/249

(Continued)

FOREIGN PATENT DOCUMENTS

WO WO 97/45622 12/1997

OTHER PUBLICATIONS

EP Search Report, Application No. EP 04 10 2792, dated Jan. 27, 2005.

(Continued)

*Primary Examiner*—David Bagnell
*Assistant Examiner*—Shane Bomar
(74) *Attorney, Agent, or Firm*—Patterson & Sheridan, L.L.P.

(57) ABSTRACT

A back-off tool for use in a tubular member disposed inside a wellbore. The back-off tool includes a housing and at least one sonic wave generator mounted within the housing. The sonic wave generator is configured to generate a plurality of sonic waves.

43 Claims, 3 Drawing Sheets

U.S. PATENT DOCUMENTS 5,387,767 A * 2/1995 Aron et al. ..... 367/25
5,727,628 A 3/1998 Patzner
5,831,934 A * 11/1998 Gill et al. ..... 367/25
5,936,913 A * 8/1999 Gill et al. ..... 367/25
6,009,948 A * 1/2000 Flanders et al. ..... 166/301
6,012,521 A * 1/2000 Zunkel et al. ..... 166/249
6,390,191 B1 * 5/2002 Melson et al. ..... 166/177.1
6,489,707 B1 12/2002 Guerrero ..... 310/334
6,605,178 B1 * 8/2003 Shinohara et al. ..... 156/379.6
2003/0024702 A1 2/2003 Gray et al. ..... 166/301

OTHER PUBLICATIONS

Australian Examination Report, Application No. 2004202676, dated Sep. 19, 2005.
Official Letter, Application No. 04102782.1, Dated Sep. 7, 2006.

* cited by examiner

METHOD AND APPARATUS FOR BACKING OFF A TUBULAR MEMBER FROM A WELLBORE

BACKGROUND OF THE INVENTION

1. Field of the Invention

Embodiments of the present invention generally relate to a pipe or drill string recovery operation in a wellbore environment, and more particularly, to a back-off tool.

2. Description of the Related Art

As wellbores are formed, various tubular strings are inserted into and removed from the wellbore. For example, drill bits and drill strings may be utilized to form the wellbore, which are typically lined with casing as the bore hole increases in depth. With today's wells, it is not unusual for a wellbore to be several thousand feet deep with the entire wellbore lined with a tubular string commonly referred to as casing. In other cases, only the upper portion of the wellbore is lined with casing and the lowest portion still open to the earth. Tubular members commonly referred to as production tubing or just tubing are also installed in the wellbore. As the well is drilled to new depths, the drill string becomes increasingly longer. Because the wells are often non-vertical or diverted, a somewhat tortuous path can be formed leading to the bottom of the wellbore where drilling takes place. Because of the non-linear path through the wellbore and other unpredictable conditions, the drill string or tubing can become bound or otherwise stuck in the wellbore as it moves axially or rotationally. The issues related to a stuck drill string may include stopping all drilling operations, thereby loosing some valuable rig time. Generally, one of the first steps in a drill string recovery operation is to determine the point at which the drill string is stuck, e.g., by using a free point tool. This step is usually followed by a back-off operation using a back-off tool.

Since a drill string is generally made up of multiple sections of a drilling pipe joined together with threaded connections, the upper portion of the drill string above the section of the pipe that has become stuck may be unthreaded/unscrewed from the lower portion of the drill string. As such, the upper portion of the drill string may be pulled out of the well. Since the threaded connection is generally tightly connected, the release of the upper portion of the drill string from the lower portion of the drill string has typically been accomplished by applying a back-off operation, which applies a left hand or reverse torque to the drill string and detonating an explosive charge adjacent the threaded connection to be released. The explosion transmits a shock wave from the explosive device to the threaded connection, which serves as a jar to the threaded connection so that the back-off torque will uncouple the upper portion from the lower portion of the drill string.

A conventional back-off tool generally includes an explosive detonating cord attached to a central steel rod which may be lowered by a wireline into the drill string. The explosive detonating cord is detonated to generate shock waves through an explosion at or proximate to a desired location. The explosion produces much the same effect as an intense hammer blow and allows the drill string to be unscrewed at the threaded connection. This prior art method, generally known as a "string shot," leaves tape debris in the well and requires side detonation from cord to cord, which is not only somewhat unreliable, but produces a ragged, non-uniform explosion which may or may not produce a shock wave of the necessary magnitude and uniformity. Moreover, the shipping costs for the detonating cords, which are typically classified as hazardous materials, are typically costly due to shipping regulations in connection with explosives.

Therefore, a need exists for a method and apparatus for releasing the upper portion of the drill string from the lower portion of the drill string without the drawbacks of conventional methods.

SUMMARY OF THE INVENTION

Various embodiments of the present invention are generally directed to a back-off tool for use in a tubular member disposed inside a wellbore. The back-off tool includes a housing and at least one sonic wave generator mounted within the housing. The sonic wave generator is configured to generate a plurality of sonic waves. Each sonic wave may have one or more predetermined frequencies.

Various embodiments of the invention are also directed to an apparatus for loosening a threaded connection joining an upper portion and a lower portion of a tubular member. The apparatus includes a back-off tool having at least one sonic wave generator and a wireline connected to the back-off tool. The wireline is configured to lower the back-off tool through the tubular member. The apparatus further includes a power supply for delivering a signal to the sonic wave generator. The sonic wave generator is configured to generate a plurality of sonic waves upon receipt of the signal.

In one embodiment, the back-off tool includes two or more sonic wave generators, each being positioned at one or more locations on the back-off tool. The two or more sonic wave generators are configured to be activated simultaneously or at predefined times so that the combined generated sonic waves are substantially greater than the sonic waves generated by each individual sonic wave generator.

Various embodiments of the invention are also directed to a method for loosening a threaded connection on a tubular member. The method includes lowering a back-off tool through the tubular member to a position substantially proximate the threaded connection and activating the back-off tool to generate a plurality of sonic waves.

Various embodiments of the invention are also directed to a method for backing-off an upper portion of a tubular member joined to a lower portion of the tubular member by a threaded connection in a wellbore. The method includes applying a reverse torque to the upper portion of the tubular member, lowering a back-off tool through the tubular member to a position substantially proximate the threaded connection joining, and generating a plurality of sonic waves through the back-off tool to loosen the threaded connection.

BRIEF DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
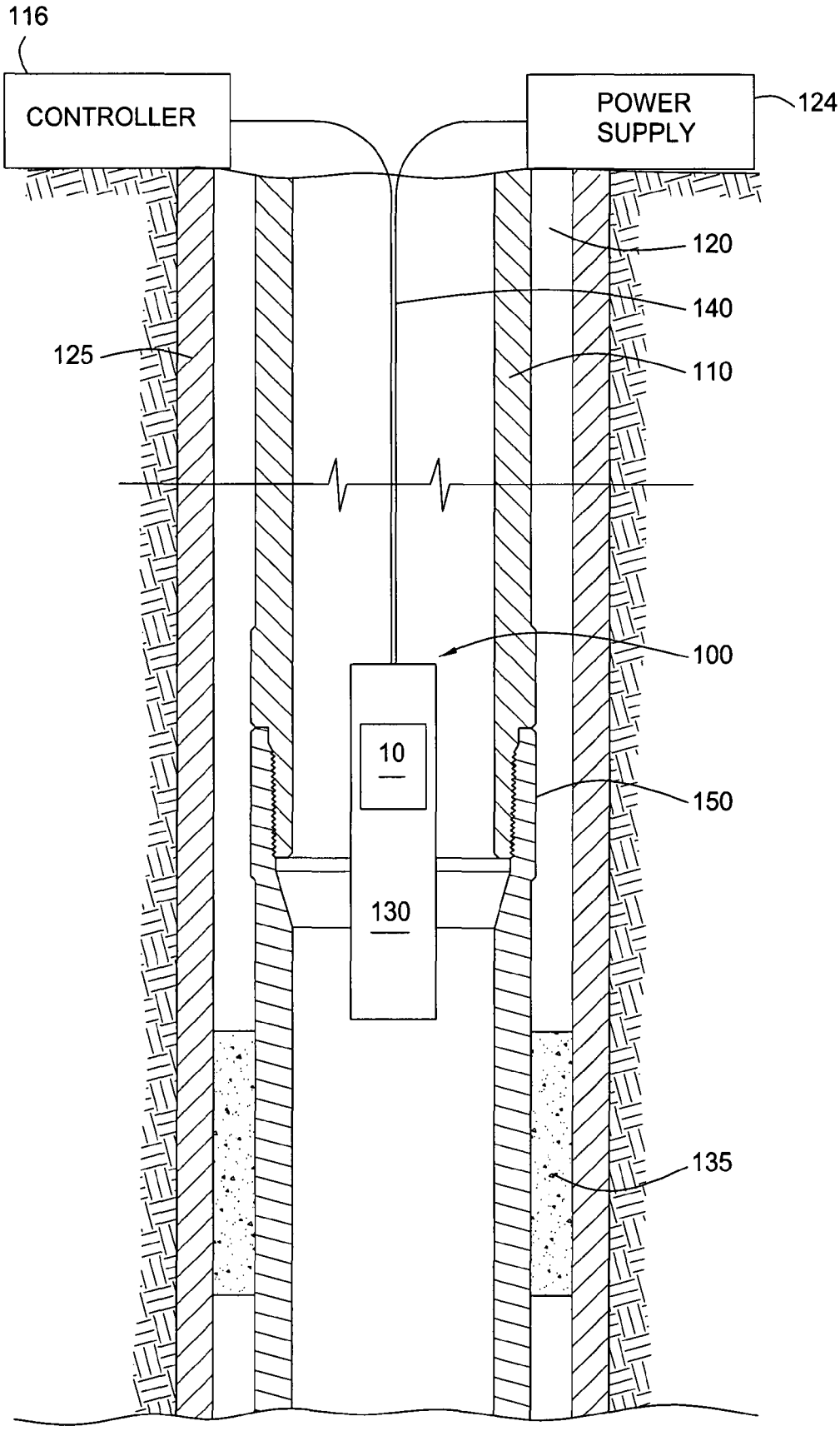
FIG. 1 illustrates a cross sectional view of a back-off tool positioned inside a tubular member in accordance with one embodiment of the invention.

A detailed description will now be provided. Various terms as used herein are defined below. To the extent a term used in a claim is not defined below, it should be given the broadest definition persons in the pertinent art have given that term, as reflected in printed publications and issued patents. In the description that follows, like parts are marked throughout the specification and drawings with the same reference numerals. The drawings may be, but are not necessarily, to scale and the proportions of certain parts have been exaggerated to better illustrate details and features of the invention.

FIG. 1 illustrates a cross sectional view of a back-off tool 100 positioned inside a tubular member 110 in accordance with one embodiment of the invention. The tubular member 110 may be a drill string, a casing, a production tubing and the like. The tubular member 110 is illustrated as being stuck by a condition 135 inside a wellbore 120, which may be lined with casing 125. The sticking condition 135 may be caused by any number of factors, including a sand bridge that may have been formed around a portion of the tubular member 110, mud solids or dehydration of mud in the annulus, a stuck packer or downhole assembly, and the like. A land well is shown for purposes of illustration; however, it is understood that the back-off tool 100 may also be used in offshore wells.

The back-off tool 100 is generally suspended inside the tubular member 110 by a wireline 140, which extends to the drilling rig at the surface of the wellbore 120. The back-off tool 100 includes a housing 130 and a sonic wave generator 10 mounted within the housing 130. The sonic wave generator 10 may be made of any material that can be induced to generate sonic, acoustical, shock or pressure waves. For example, the sonic wave generator 10 may be made from a piezoelectric crystal or ceramic, magnetostrictive materials, barium titanate, quartz and the like. The sonic wave generator 10 may also be a stack of piezoelectric plates fabricated from wafers of quartz, lithium niobate, lithium tantalate or ceramics. The stack of piezoelectric plates, which are cut generally in the x crystal axis direction, may be deposited with silver alloy for conductivity and mechanical strength, then stacked and melted together under vacuum and applied pressure.

The sonic wave generator 10 is electrically connected to a power supply 124 configured to deliver an electrical signal to the sonic wave generator 10. The sonic wave generator 10 is configured to vibrate in response to receiving the electrical signal from the power supply 124, thereby generating the sonic waves. The sonic wave generator 10 may also be connected to a controller 116, which is configured to control the activation of the sonic wave generator 10. The controller 116 may also vary the frequency, amplitude or resonance of the sonic waves.

The controller 116 has a central processing unit (CPU), a memory, and support circuits for the CPU. The CPU may be one of any form of general purpose computer processor that can be used in an industrial setting for controlling various devices, such as the sonic wave generator 10. The memory is coupled to the CPU and may be one or more of readily available memory, such as random access memory (RAM), read only memory (ROM), floppy disk, hard disk, or any other form of digital storage, local or remote. The support circuits are coupled to the CPU for supporting the processor in a conventional manner. These circuits may include cache, power supplies, clock circuits, input/output circuitry and subsystems, and the like.

The back-off tool 100 is generally positioned substantially proximate or adjacent a threaded connection 150 so that the sonic waves generated by the sonic wave generator 10 may loosen the threaded connection 150.

Figure 2:
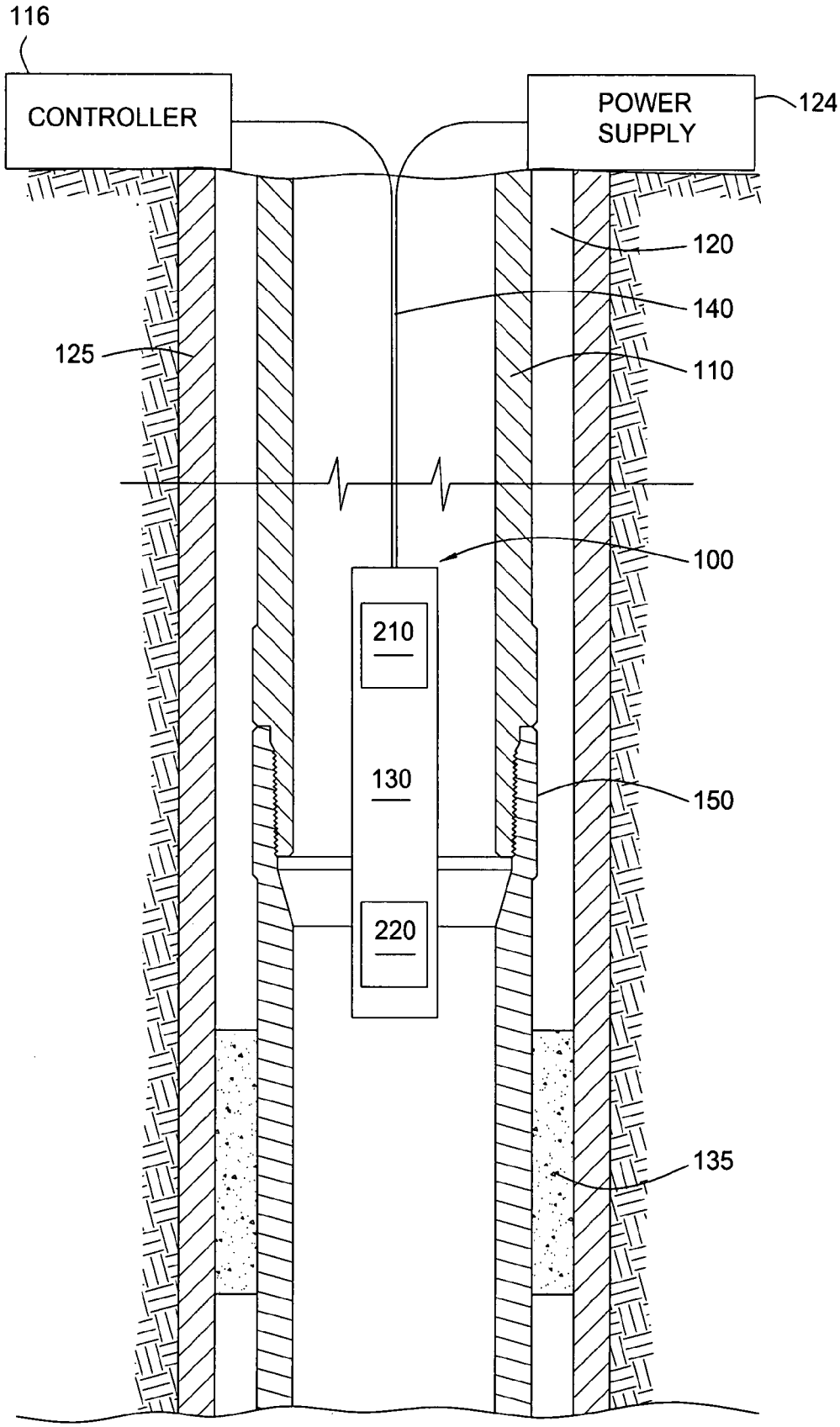
FIG. 2 illustrates a cross sectional view of a back-off tool positioned inside a tubular member in accordance with one embodiment of the invention.

In one embodiment, the back-off tool 100 includes two sonic wave generators 210 and 220, as shown in FIG. 2. In this embodiment, the two sonic wave generators 210 and 220 may be positioned on either side of the threaded connection 150 to be released such that the combined amplitude of the sonic waves is greater than the amplitude of the sonic waves from a single sonic wave generator 10. In yet another embodiment, the back-off tool 100 includes a plurality of sonic wave generators. In these embodiments, the sonic wave generators may be activated simultaneously or at predefined times.

Figure 3:
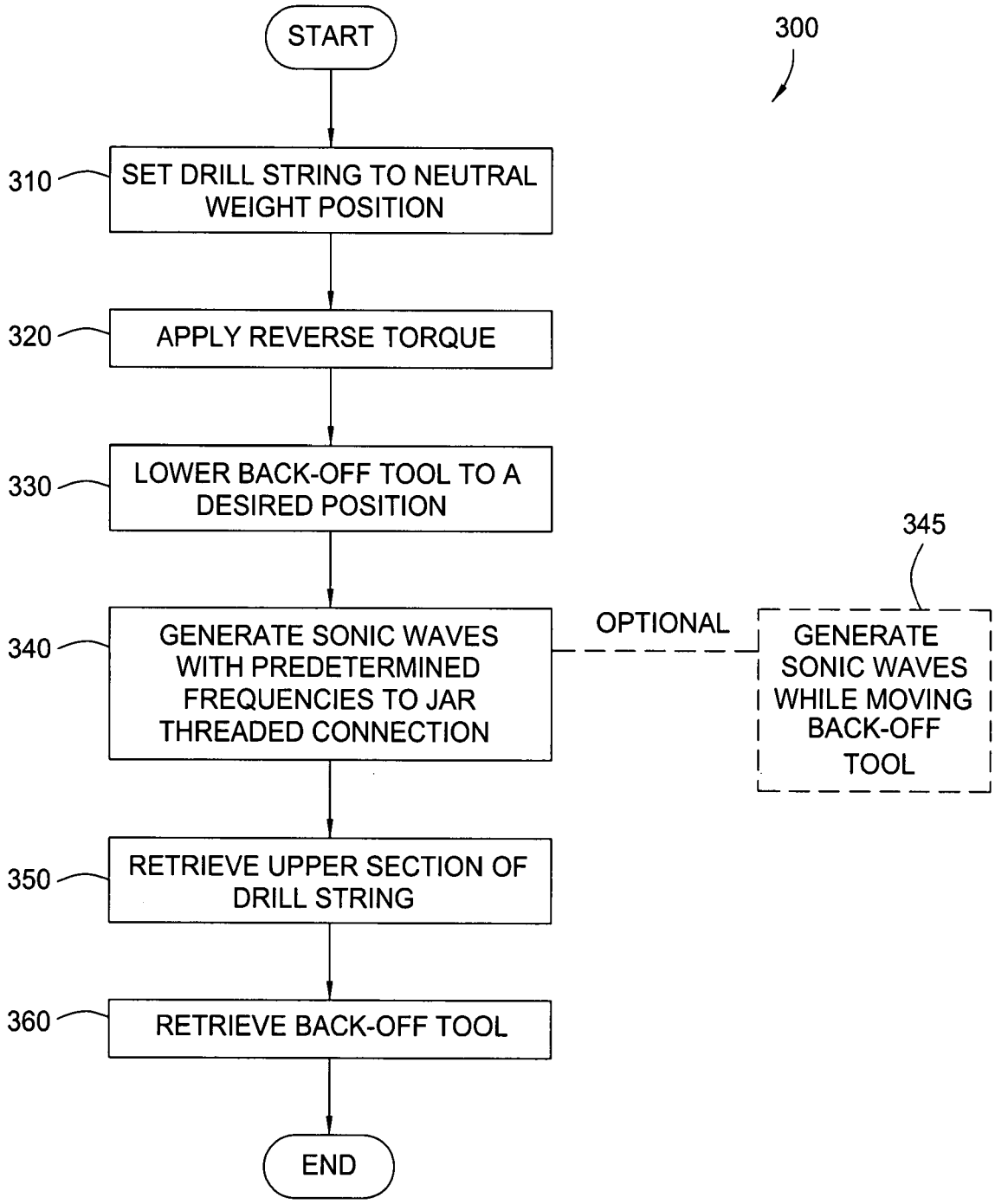
FIG. 3 illustrates a method of backing off a tubular member from a wellbore in accordance with one embodiment of the invention.

FIG. 3 illustrates a method 300 of backing off an upper portion of a tubular member 110 from a wellbore 120 in accordance with one embodiment of the invention. Once the sticking condition has been identified and located, the tubular member 110 may be set to a neutral weight position at threaded connection 150 (step 310), i.e., setting the tubular member in neither tension or compression. Setting the neutral weight position is typically accomplished by reciprocating the tubular member 110. The tubular member 110 may contract and expand as tension is applied at the surface of the wellbore 120. As such, the tubular member 110 may be lifted to reduce the weight of the upper portion of the tubular member 110, thereby counteracting forces on the threaded connection 150 preventing the release.

At step 320, a reverse torque is applied to the tubular member 110 from the surface. The back-off tool 100 is then lowered through the tubular member 110 to a desired position (step 330). In one embodiment, the desired position is substantially proximate the first threaded connection 150 above the sticking condition 135. In another embodiment, the desired position is substantially proximate the first threaded connection 150 inside the casing 125 above the sticking condition 135. In yet another embodiment, the tubular member may be set to the neutral weight position after the back-off tool 100 has been lowered to the desired position. Alternatively, the reverse torque may be applied after the back-off tool 100 has been lowered.

At step 340, the sonic wave generator 10 is activated to generate sonic waves to jar or loosen the threaded connection 150. In one embodiment, the sonic waves are generated while the tubular member 110 is set to its neutral weight position. The sonic waves are configured to produce much the same effect as an intense hammer blow, thereby loosening the threaded connection 150 and allowing the upper portion of the tubular member 110 to be unscrewed from the lower portion of the tubular member 110. The sonic waves are transmitted to the threaded connection 150 through liquid or gas medium in the wellbore 120. The sonic wave generator 10 may be activated by receiving an electrical signal from the power supply 124. Furthermore, the activation of the sonic wave generator 10 may be controlled by the controller 116. In one embodiment, the sonic wave generator 10 may be repeatedly activated to generate the sonic waves until the threaded connection 150 is loosened. A reverse torque and the neutral weight setting at threaded connection 150 may be applied after or while the sonic wave generator 10 is activated.

In one embodiment, the sonic waves are repeatedly or continuously generated while the back-off tool 100 is being moved upwardly or downwardly (step 345). For example, the sonic waves may be generated: (i) while the back-off tool 100 is being lowered to the desired position, i.e., even before the back-off tool 100 reaches the desired position; (ii) while the back-off tool 100 is being pulled upwardly; (iii) while the back-off tool 100 is being lowered pass the threaded connection 150 and pulled upwardly, as in a sweeping motion. In this manner, various embodiments of the invention allow the sonic wave generator 10 to generate the sonic waves while moving the back-off tool 100 up and down until the sonic waves reach the threaded connection 150 while the tubular member 110 is at the neutral weight position, thereby loosening the threaded connection 150.

In another embodiment, the sonic waves are repeatedly or continuously generated while the tubular member 110 is being reciprocated. As the tubular member is being reciprocated, the neutral weight position is moving along the tubular member 110. While the neutral weight position is moving up and down the tubular member 110, the sonic waves are generated toward the tubular member 110. In this manner, as the neutral weight position moves through the threaded connection 150, the sonic waves applied at the threaded connection 150 loosen the threaded connection 150.

In yet another embodiment, the sonic wave generator 10 is configured to generate sonic waves at one or more predetermined frequencies. The frequency of the sonic waves may be varied via the controller 116. In addition, the frequency and/or resonance of the sonic waves may be varied according to the proximity of the threaded connection 150 to the sticking condition 135. For example, the closer the threaded connection 150 is to the sticking condition 135, generally the higher the frequency and/or resonance required to loosen the threaded connection 150. Further, the amplitude of the sonic waves may also be varied by the controller 116.

Once the threaded connection 150 is loosened or jarred by the sonic waves generated by the sonic wave generator 10, the upper portion of the tubular member 110 may be retrieved from the wellbore 120 (step 350). In this manner, the combination of the sonic wave generation and the application of the reverse torque is configured to loosen the threaded connection 150 so that the upper portion of the tubular member 110 may be retrieved from the well bore, leaving the lower portion of the tubular member 110 in the wellbore 120 for subsequent fishing operations and the like. At 360, the back-off tool is removed from the tubular member by pulling upwardly with the wireline 140.

Various embodiments of the invention have many advantages, among which is that the sonic wave generator 10 may be activated any number of times without having to retrieve the back-off tool 100, unlike current conventional back-off tools, which require retrieval of the back-off tool 100 and replacement of the detonation charge for each jarring event, e.g., an explosion using detonating cord. Further, various embodiments of the invention substantially eliminate the use of hazardous materials as a jarring mechanism. In addition to loosening threaded connections, various embodiments of the invention may be used for releasing stuck packers, fishing tools and the like, removing corrosion from pipe, opening perforations, jumping collars, bumping drill pipe loose in key seats, removing jet nozzles in drill bits to increase rate of circulation, and the like.

While the foregoing is directed to embodiments of the present invention, other and further embodiments of the invention may be devised without departing from the basic scope thereof, and the scope thereof is determined by the claims that follow.

What is claimed is:

1. A method for loosening a threaded connection on a tubular member, comprising:

lowering a back-off tool through the tubular member to a position substantially proximate the threaded connection, wherein the back-off tool comprises two or more sonic wave generators, each having at least one of a piezoelectric ceramic and a stack of piezoelectric plates;

activating the two or more sonic wave generators simultaneously to cause the sonic wave generator to generate sonic waves; and setting the tubular member to a neutral weight position at the threaded connection above a sticking condition.

2. The method of claim 1, wherein the sonic waves are configured to loosen the threaded connection.

3. The method of claim 1, further comprising applying a reverse torque to the tubular member.

4. The method of claim 1, wherein the back-off tool is activated while moving the neutral weight position up and down the tubular member.

5. The method of claim 1, wherein each sonic wave generator has at least one of the piezoelectric ceramic and the stank of piezoelectric plates.

6. The method of claim 1, wherein each sonic generator has at least one of the piezoelectric crystal, ceramic, and stack and the piezoelectric crystal, ceramic, or stack is made from barium titanate or quartz.

7. The method of claim 1, wherein each sonic wave generator has the stack of piezoelectric plates and the piezoelectric plates are made from wafers of at least one of quartz, lithium niobate, lithium tantalite, and ceramics.

8. The method of claim 7, further comprising cutting the piezoelectric plates generally in the x crystal axis direction.

9. The method of claim 8, further comprising depositing the piezoelectric plates with a silver alloy; stacking the piezoelectric plates; and melting the silver alloy under a vacuum while applying pressure to the stack.

10. The method of claim 1, further comprising varying one or more frequencies of the sonic waves.

11. A method for loosening a threaded connection on a tubular member, comprising:

lowering a back-off tool through the tubular member to a position substantially proximate the threaded connection, wherein the back-off tool comprises a sonic wave generator having at least one of a piezoelectric ceramic, a piezoelectric crystal, a magnetostrictive material, and a stack of piezoelectric plate; and activating the sonic wave generator to generate sonic waves while reciprocating the tubular member.

12. The method of claim 11, wherein the sonic wave generator has at least one of the piezoelectric ceramic and the stack of piezoelectric plates.

13. The method of claim 11, wherein the sonic generator has at least one of the piezoelectric crystal, ceramic, and stack and the piezoelectric crystal, ceramic, or stack is made from barium titanate or quartz.

14. The method of claim 11, wherein the sonic wave generator has the stack of piezoelectric plates and the piezoelectric plates are made from wafers of at least one of quartz, lithium niobate, lithium tantalite, and ceramics.

15. The method of claim 14, further comprising cutting the piezoelectric plates generally in the x crystal axis direction.

16. The method of claim 15, further comprising depositing the piezoelectric plates with a silver alloy; stacking the piezoelectric plates; and melting the silver alloy under a vacuum while applying pressure to the stack.

17. The method of claim 11, further comprising varying one or more frequencies of the sonic waves.

18. A method for backing-off an upper portion of a tubular member joined to a lower portion of the tubular member by a threaded connection in a wellbore, comprising:

applying a reverse torque to the upper portion of the tubular member;

lowering a back-off tool through the tubular member to a position substantially proximate the threaded connection, wherein the back-off tool comprises a sonic wave generator having at least one of a piezoelectric ceramic, a piezoelectric crystal, a magnetostrictive material, and a stack of piezoelectric plates; and generating sonic waves through the back-off tool to loosen the threaded connection, while moving a neutral weight position along the tubular member.

19. The method of claim 18, further comprising activating the back-off tool to generate the sonic waves.

20. The method of claim 18, further comprising setting the tubular member to the neutral weight position at the threaded connection above a sticking condition.

21. The method of claim 18, further comprising varying one or more frequencies of the sonic waves.

22. The method of claim 18, further comprising retrieving the upper portion from the wellbore.

23. The method of claim 18, wherein the sonic wave generator has at least one of the piezoelectric ceramic and the stack of piezoelectric plates.

24. The method of claim 18, wherein the sonic generator has at least one of the piezoelectric crystal, ceramic, and stack and the piezoelectric crystal, ceramic, or stack is made from barium titanate or quartz.

25. The method of claim 18, wherein the sonic wave generator has the stack of piezoelectric plates and the piezoelectric plates are made from wafers of at least one of quartz, lithium niobate, lithium tantalite, and ceramics.

26. The method of claim 25, further comprising cutting the piezoelectric plates generally in the x crystal axis direction.

27. The method of claim 26, further comprising depositing the piezoelectric plates with a silver alloy; stacking the piezoelectric plates; and melting the silver alloy under a vacuum while applying pressure to the stack.

28. A method for loosening a threaded connection on a tubular member, comprising:

lowering a back-off tool through the tubular member to a position substantially proximate the threaded connection, wherein the back-off tool comprises a sonic wave generator having at least one of a piezoelectric ceramic, a piezoelectric crystal, a magnetostrictive material, and a stack of piezoelectric plates; and activating the back-off tool to cause the sonic wave generator to generate sonic waves, while moving a neutral weight position up and down the tubular member.

29. The method of claim 28, wherein the sonic wave generator has at least one of the piezoelectric ceramic and the stack of piezoelectric plates.

30. The method of claim 28, wherein the sonic generator has at least one of the piezoelectric crystal, ceramic, and stack and the piezoelectric crystal, ceramic, or stack is made from barium titanate or quartz.

31. The method of claim 28, wherein the sonic wave generator has the stack of piezoelectric plates and the piezoelectric plates are made from wafers of at least one of quartz, lithium niobate, lithium tantalite, and ceramics.

32. The method of claim 31, further comprising cutting the piezoelectric plates generally in the x crystal axis direction.

33. The method of claim 32, further comprising depositing the piezoelectric plates with a silver alloy; stacking the piezoelectric plates; and melting the silver alloy under a vacuum while applying pressure to the stack.

34. The method of claim 28, further comprising varying one or more frequencies of the sonic waves.

35. A method for loosening a threaded connection on a tubular member, comprising:

lowering a back-off tool through the tubular member to a position substantially proximate the threaded connection, wherein the back-off tool comprises two or more sonic wave generators, each having at least one of piezoelectric ceramic, a piezoelectric crystal, a magnetostrictive material, and a stack of piezoelectric plates; and activating the two or more sonic wave generators simultaneously to cause the sonic wave generators to generate sonic waves, wherein the back-off tool is activated while moving a neutral weight position up and down the tubular member.

36. The method of claim 35, wherein the sonic waves are configured to loosen the threaded connection.

37. The method of claim 35, further comprising applying a reverse torque to the tubular member.

38. The method of claim 35, wherein the sonic wave generator has at least one of the piezoelectric ceramic and the stack of piezoelectric plates.

39. The method of claim 35, wherein the sonic generator has at least one of the piezoelectric crystal, ceramic, and stack and the piezoelectric crystal, ceramic, or stack is made from barium titanate or quartz.

40. The method of claim 35, wherein the sonic wave generator has the stack of piezoelectric plates and the piezoelectric plates are made from wafers of at least one of quartz, lithium niobate, lithium tantalite, and ceramics.

41. The method of claim 40, further comprising cutting the piezoelectric plates generally in the x crystal axis direction.

42. The method of claim 41, further comprising depositing the piezoelectric plates with a silver alloy; stacking the piezoelectric plates; and melting the silver alloy under a vacuum while applying pressure to the stack.

43. The method of claim 35, further comprising varying one or more frequencies of the sonic waves.

* * * * *

UNITED STATES PATENT AND TRADEMARK OFFICE

CERTIFICATE OF CORRECTION

PATENT NO. : 7,195,069 B2
APPLICATION NO. : 10/607510
DATED : March 27, 2007
INVENTOR(S) : John Roberts It is certified that error appears in the above-identified patent and that said Letters Patent is hereby corrected as shown below:

In the Claims:

In Column 6, Claim 1, Line 11, between "ceramic" and "and" please insert --, a piezoelectric crystal, a magnetostrictive material,--;

In Column 6, Claim 1, Line 14, please delete "generator" and insert --generators--;

In Column 6, Claim 5, Line 27, please delete "stank" and insert --stack--;

In Column 6, Claim 11, Line 51, please delete "plate" and insert --plates--.

Signed and Sealed this

Seventh Day of August, 2007

JON W. DUDAS
*Director of the United States Patent and Trademark Office*